US005693142A

United States Patent [19]

Pedigrew et al.

[11] Patent Number: 5,693,142

[45] Date of Patent: Dec. 2, 1997

[54] WHEEL APPLICATOR DEVICE FOR APPLYING ADHESIVE, ESPECIALLY TO THE SPINES OF BOOKS DURING BOOKBINDING

[75] Inventors: Colin Pedigrew, Erkrath; Andrew Nixon, Meerbusch, both of Germany

[73] Assignee: Nordson Corporation, Westlake, Ohio

[21] Appl. No.: 530,183

[22] PCT Filed: Mar. 25, 1994

[86] PCT No.: PCT/US94/03297

§ 371 Date: Dec. 4, 1995

§ 102(e) Date: Dec. 4, 1995

[87] PCT Pub. No.: WO94/22593

PCT Pub. Date: Oct. 13, 1994

[30] Foreign Application Priority Data

Mar. 26, 1993 [DE] Germany ..... 93 04 504 U

[51] Int. Cl.[6] ..... B05C 1/00

[52] U.S. Cl. ..... 118/261; 118/110; 118/203; 118/244; 118/258; 156/578; 156/908; 412/37

[58] Field of Search ..... 118/110, 112, 118/118, 123, 200, 203, 244, 258, 261, 602; 156/578, 908; 412/8, 37

[56] References Cited

U.S. PATENT DOCUMENTS

| | | |
|---|---|---|
| 2,483,652 | 10/1949 | Lee . |
| 2,605,739 | 8/1952 | Florez . |
| 3,255,727 | 6/1966 | Boothroyd . |
| 3,294,060 | 12/1966 | McIntyre et al. . |
| 3,334,612 | 8/1967 | Lucas . |
| 3,373,052 | 3/1968 | Rode . |
| 3,636,921 | 1/1972 | Lockwood . |
| 3,707,135 | 12/1972 | Sharpe et al. . |
| 3,718,115 | 2/1973 | Lee . |
| 3,788,270 | 1/1974 | Blair . |
| 3,800,702 | 4/1974 | Roberts . |
| 3,866,568 | 2/1975 | Minami . |
| 3,976,029 | 8/1976 | Rosner . |
| 3,980,514 | 9/1976 | Rosette et al. . |
| 4,014,287 | 3/1977 | Green . |
| 4,244,200 | 1/1981 | Sando et al. . |
| 4,270,967 | 6/1981 | Cone . |
| 4,335,674 | 6/1982 | Winker et al. . |
| 4,373,985 | 2/1983 | Glendening . |
| 4,736,703 | 4/1988 | Mattei et al. . |
| 5,129,772 | 7/1992 | Slautterback . |
| 5,154,447 | 10/1992 | Tooker . |
| 5,250,318 | 10/1993 | Tooker . |
| 5,362,188 | 11/1994 | Tooker . |
| 5,417,797 | 5/1995 | Tooker . |
| 5,538,570 | 7/1996 | Tooker . |

FOREIGN PATENT DOCUMENTS

| | | |
|---|---|---|
| 0376207 | 7/1990 | European Pat. Off. . |
| 2134420 | 8/1994 | United Kingdom . |

OTHER PUBLICATIONS

Patent Abstracts of Japan, JP59183856, Oct.19, 1984, vol. 9, No. 41, Fuji Xerox KK, Apparatus for Coating Bookbinding Adhesive, Inventor Koizumi Susumu.

Technical Publication, 44–2.0, Hot Melt Wheel Model H–54 Series, 11 pp. Issued Mar. 1983, Nordson Corporation.

Hot Melt Applicator Heads, 1 p., Dec. 1976, Nordson Corporation.

*Primary Examiner*—Laura Edwards

*Attorney, Agent, or Firm*—Wood, Herron & Evans, L.L.P.

[57] ABSTRACT

Wheel apparatus (1) for applying adhesive to books includes a wheel (30) rotating about a horizontal axis. A portion of the wheel below the axis rotates between two walls (90) rising from the bottom of the adhesive reservoir (34). A metering surface (84) extends from a step (80) near the bottom of the wheel in a curve slightly diverging from the wheel to a terminal edge (88) extending between walls (90). Walls (90) and step (80) and surface (84) serve to meter the amount of adhesive carried by wheel (30) for application. Walls (90) are spaced from side walls (70, 72) to form recirculate channels for adhesive. The wheel (30) and a counter-rotary spinner wheel (32) are carried by a frame (46) pivoted on reservoir (34) so the wheel (30, 32) can be moved away from reservoir (34) for cleaning purposes.

10 Claims, 5 Drawing Sheets

WHEEL APPLICATOR DEVICE FOR APPLYING ADHESIVE, ESPECIALLY TO THE SPINES OF BOOKS DURING BOOKBINDING

BACKGROUND OF THE INVENTION

The invention pertains to a wheel applicator device for the mechanized application of an adhesive to workpieces, especially to the spines of books during the process of bookbinding, with a glue tank open at the top; a driven applicator wheel capable of rotating around a horizontal axis; the lower part of the applicator wheel being immersed in the glue tank filled with adhesive; the top apex line of the upper peripheral surface of the applicator wheel being situated on a plane in which the book spines to be glued are being pushed forward at adjustable speed by the conveyors and guides of a bookbinding machine, so that the adhesive which was picked up in the lower part of the glue tank and which is adhering to the periphery of the applicator wheel is transferred to the book spines; the peripheral velocity of the applicator wheel being coordinated with the transport speed of the book blocks, the direction of the wheel's rotation in the upper area corresponding to the feed direction of the book blocks.

Wheel applicators of this type are known and are used to apply liquids, especially adhesives, in the processing of, for example, leather, paper, wood, and other natural and synthetic materials and in bookbinding.

In bookbinding by spreading glue on the spines of the books and then attaching the covers, it is known that wheel applicator devices can be connected to bookbinding machines. According to the state of the art, this coupling is implemented in such a way that the wheel applicator is flanged by its housing or frame to the bookbinding machine by means of appropriate fastening means, such as screw joints. To drive the applicator wheel of the wheel applicator device at a speed such that the peripheral velocity of the applicator wheel matches the feed or transport speed of the book blocks to be bound, the applicator wheel in the known devices is coupled by way of a gear wheel to the bookbinding machine. For this purpose, either a shaft coupling or the gear wheel is installed inside the flange connection. In this way, the applicator wheel is driven at the correct rotational speed.

A coupling of this type between a wheel applicator device and a bookbinding machine suffers from the several disadvantages. It takes a great deal of mechanical work to assemble and disassemble the flange joint between the bookbinding machine and the wheel applicator, and the necessary fastening means must be provided on both devices. When a wheel applicator is to be used alternately on different bookbinding machines, either the dimensions of the flange connection must be identical, or custom-made adapters must be available for the various attachments. The flange joint must also be fabricated with special precision to ensure trouble-free, low-loss transmission of the mechanical power required to drive the wheel applicator, this power being transmitted by means of gear wheels, which must themselves be precisely aligned. This precision fabrication is required to ensure that the applicator wheel is positioned accurately vis-Avis the book spines to be glued.

When polyurethane is used in wheel applicators to glue the spines of the books, the sensitivity of polyurethane to moisture leads relatively quickly to the decomposition of the polyurethane being held ready in the glue tank. As a result, it is frequently necessary to clean the glue tank so that the properties of the adhesive can be guaranteed. Doctor blades are used on the applicator wheel to wipe off excess adhesive and to help form a uniform layer of adhesive on the wheel.

The present invention is based on the task of providing a wheel applicator which eliminates almost all of the disadvantages of the state of the art, can be used in an especially simple manner in conjunction with various bookbinding machines, and which, especially when use is being made of polyurethane as adhesive, gives favorable results with respect to the application of the adhesive.

According to the invention, the task is accomplished in that a wheel applicator of the type indicated above is given its own drive unit with an electric motor for driving the applicator wheel and is provided with an electronic control device for the electric motor. The control device can be coupled to an electric signal transmitter, which is installed inside the bookbinding machine. A signal corresponding to the speed of the book blocks is available at the output of this transmitter for use by the control device.

In the wheel applicator according to the invention, the drive wheel is driven by a drive unit independent of the bookbinding machine, the power being supplied by an electric motor; the speed of the drive wheel is no longer controlled "mechanically", as in the state of the art, but rather by means of an electric signal from the bookbinding machine, which corresponds to the speed of the book blocks. As a result, it is easy to use the wheel applicator on different bookbinding machines, because there is no longer any need for complicated mechanical power transmission systems to drive the applicator wheel or for different transmissions to adapt the speed of the machinery mechanically. As a result, it is much easier to couple the devices. The wheel applicator is simply positioned relative to the bookbinding machine, and a signal cable, for example, which is connected to a sensor located in the bookbinding machine, is plugged into the applicator.

An advantageous embodiment of the invention is characterized in that a spinner roll, driven by the drive unit, is installed parallel to and behind the applicator wheel, i.e., behind in terms of the direction in which the book blocks are being conveyed. This spinner roll can be brought into contact with the layer of adhesive which has been transferred to the book spines. This spinner roll has the function of pressing the adhesive which has been applied to the spine into the intermediate spaces between the individual pages of the book and of removing excess adhesive from the spine. It is advantageous in this case for the spinner roll to turn in the direction opposite that of the applicator wheel and for the distance between the spinner roll and the plane of the book spines to be adjustable, because this makes it possible to improve the application of the adhesive and to improve the quality of the adhesive bond.

An embodiment in which the above-mentioned parts of the wheel applicator are held in a frame attached in a height-adjustable manner to a stand is especially advantageous. When it is desired to use the same wheel on different machines, therefore, the wheel applicator device and especially the applicator wheel itself can be easily positioned with respect to the bookbinding machine. It is advantageous for the actual height of the frame and/or of the applicator wheel to be visibly displayed on a display unit so that the height can be adjusted quickly and precisely.

In another especially advantageous embodiment, the entire wheel applicator device can be moved around on rollers, which are attached to the stand. The device can thus be moved to the desired location and immobilized by the use of clamps, which lock the rollers. This is highly advantageous, because the wheel applicator can thus be positioned very quickly and conveniently at different bookbinding machines. The horizontal position of the wheel applicator can be adjusted by simply pushing the stand; the vertical alignment can be adjusted by manual actuation of an adjusting device.

In accordance with an advantageous embodiment, the field of application of the device can be expanded even more by mounting the applicator wheel and the spinner wheel on an exposed part of the frame, which can be moved underneath the conveyors and guides of the bookbinding machine. As a result, it is possible to use the applicator on different bookbinding machines with openings of different sizes.

The applicator wheel and/or the glue tank are preferably heated electrically or by means of a fluid thermal transfer medium, so that the fluid- dynamic properties of the adhesives used can be controlled by the input of thermal energy. In this way, it becomes possible either for the adhesive to be applied at all or for the quality of its application to be improved.

Advantageous in this respect is another embodiment, which is characterized by a built-in doctor blade device at the bottom of the glue tank, near the lower part of the applicator wheel, consisting of a step located approximately at the lowermost point of the wheel periphery and extending axially with respect to the wheel, this step being located between a first curved section of the glue tank relatively far away from the peripheral surface of the wheel and a second curved section, following in the direction of rotation, relatively close to the peripheral surface. The result achieved by means of a design such as this is that only the amount of adhesive that actually needs to be applied to the spine is in fact transferred to the rotating applicator wheel and that, overall, only a small amount of adhesive needs to be kept ready in the open glue tank, which means that adhesives such as polyurethane in particular, which decompose under certain conditions, can be used successfully. By means of properly located inlet and outlet openings in the bottom of the glue tank in conjunction with the described doctor blade device, the effect is achieved that most of the freshly prepared adhesive which is supplied to the glue tank is transferred immediately to the peripheral surface of the applicator wheel and from there to the spines of the books.

This embodiment is improved even more when a trough-like doctor blade device opening out toward the top is realized. Advantages are also to be derived from an applicator wheel with conical end surfaces, to which the side walls of the trough of the doctor blade conform, these walls being very close to the conical end surfaces and ending at a level which corresponds to approximately one-third of the diameter of the applicator wheel.

An embodiment of the invention in which the applicator wheel and the spinner wheel are mounted jointly on a separate frame, which is attached to the main frame in such a way that it can be flipped upward, is especially advantageous, because after the applicator wheel, the spinner roll, and all of the doctor blade devices have been flipped into the up position, they are very easy to clean. In this condition, it is then also very easy to clean the glue tank.

BRIEF DESCRIPTION OF THE DRAWINGS

In the following, the invention is explained on the basis of the embodiments shown in the drawings.

DETAILED DESCRIPTION OF THE INVENTION

Figure 2:
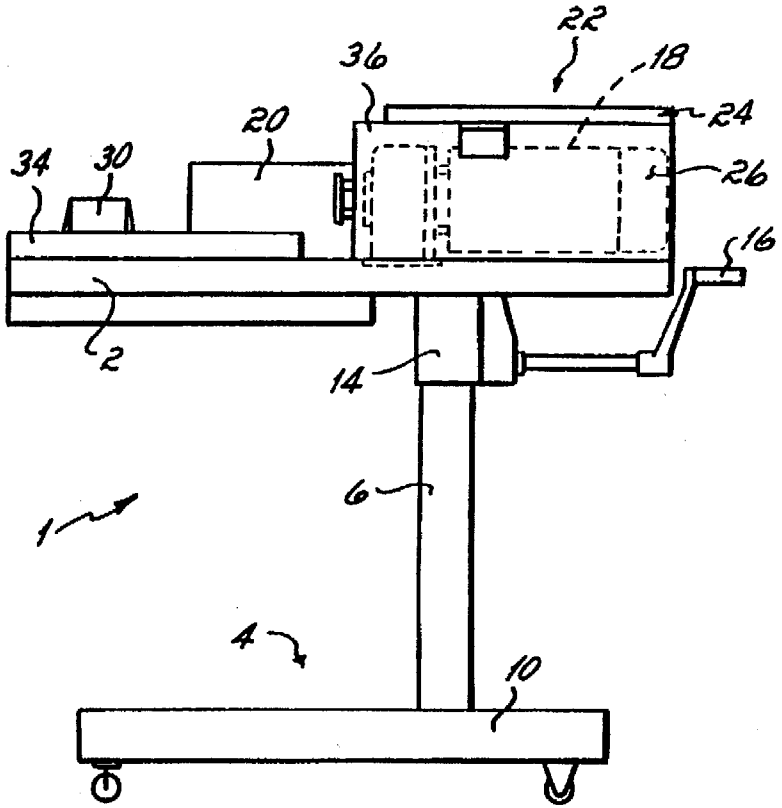
FIG. 2 shows a side view of the wheel applicator device according to FIG. 1.
Figure 1:
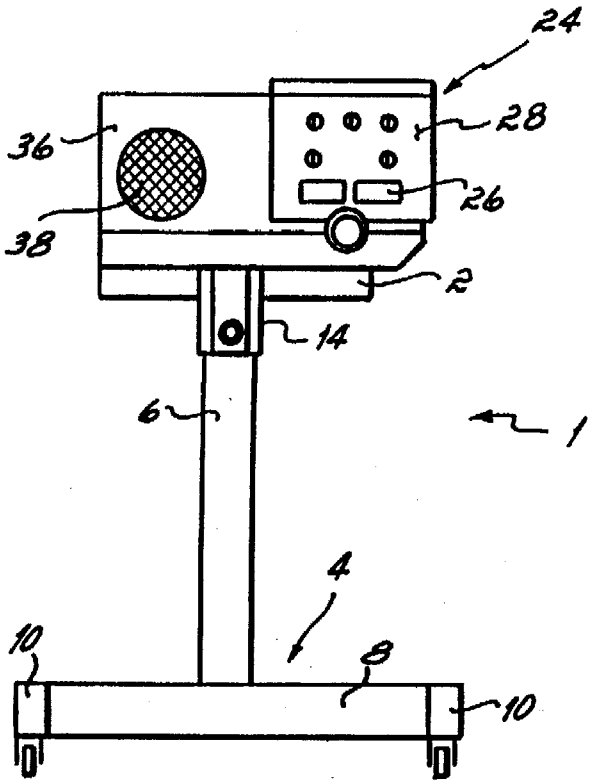
FIG. 1 shows a front view of a wheel-type applicator device.
Figure 3:
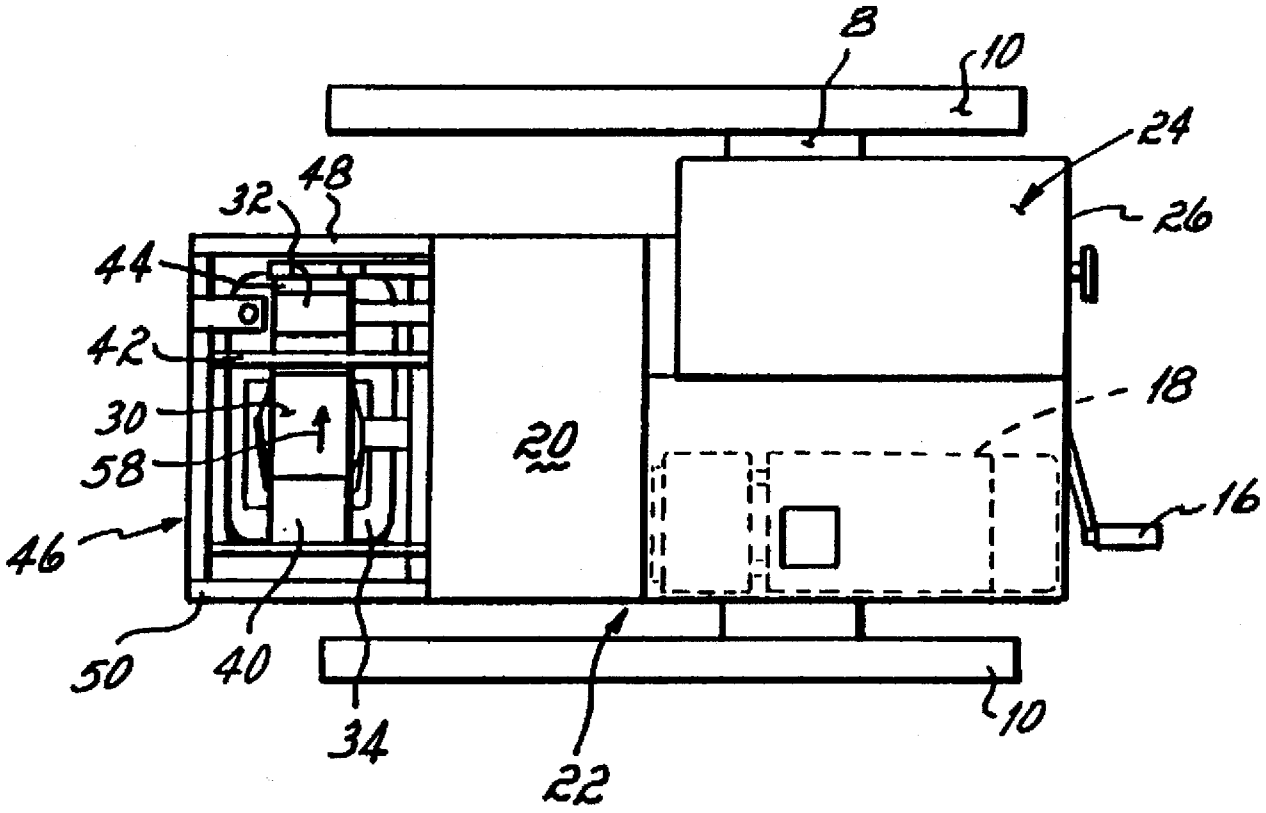
FIG. 3 shows a top view onto the wheel applicator device of FIGS. 1 and 2.

As can be seen from the three different views given in FIGS. 1, 2, and 3, a frame 2, which extends essentially in a horizontal plane, is connected in this embodiment of the wheel applicator to a vertically oriented gear column 6, belonging to a machine stand 4. The lower end of gear column 6 is rigidly connected to two horizontal crossbraces 8, designed as hollow sections, which are in turn welded at their ends to two beams 10. Two rollers are provided on the bottom of each of the two beams 10, which means that the entire wheel applicator device I can be rolled around on machine stand 4. On each beam 10, one of the rollers is supported so that it can pivot around a vertical axis and can be locked with clamps (not shown). Wheel applicator 1 can thus be immobilized in the desired location. As an alternative, it is also possible to hold the device in position by the use of vertically oriented, threaded holes in the ends of beams 10, in which rotatable, threaded bolts provided with foot-like ends are inserted, on which the device can be positioned without shifting and which take over the support function of the rollers.

The upper end of gear column 6 is provided on its external side with teeth in the manner of a toothed rack and is held inside a bearing block 14 in such a way that it can neither slide in the axial direction nor rotate; the bearing block is rigidly connected to the bottom of frame 2, and a plurality of teeth on gear column 6 engage with a pinion (not shown) supported inside bearing block 14. This pinion can be turned by a hand crank, which operates a gear box also mounted inside bearing block 14. When hand crank 16 is turned, frame 2 therefore moves up or down in the vertical direction depending on the whether hand crank 16 is turned clockwise or counterclockwise; the frame can be looked at the desired height by means of a clamp device (not shown), which is a component of bearing block 14. Instead of hand crank 16, a drive motor can also be used to adjust the height of the frame in this way. In this exemplary embodiment, the range over which the frame can be adjusted is about 100 mm. A distance pickup is mounted on bearing block 14; in cooperation with a pulse transmitter attached to gear column 6, such as a transmitter in the form of a magnetically coded tape measure, this pickup makes it possible to determine the position of the frame relative to gear column 6 and thus to determine the height of the frame relative to the floor. The height value is shown on a display unit 26.

As is especially clear from FIGS. 2 and 3, a drive unit 22, consisting of an electric motor 18 and a transmission unit 20; an electronic control device 24 with display unit 26; a control panel 28; an applicator wheel 30; a spinner roll 32; and a glue tank 34 are mounted on frame 2. Electric motor 18 is housed horizontally above frame 2, inside a motor housing 36 provided with an air vent 38; the rotary motion can be transferred by way of the motor's output shaft to transmission unit 20. In addition, the motor is electrically connected to electronic control device 24, which is installed inside a housing next to motor housing 36. Electric motor 18 is supplied with voltage from the outside by this controller, which can also control the rpm's of the motor. Display unit 26, which is connected electrically to the controller and which is in the form of one or more digital displays, and control panel 28 are installed in one of the ends of the housing of electronic controller 24 (see FIG. 1 .) The signal originating from the distance pickup, which is housed connected to (the source of) a signal for controlling the speed of electric motor 18.

According to FIGS. 2 and 3, glue tank 34, which is open at the top, applicator wheel 30, and spinner roll 32 are installed at the end of frame 2, opposite electronic control device 24 and electric motor 18. Applicator wheel 30 and spinner roll 32 are mounted cantilever fashion inside transmission unit 20 so that they can rotate around a horizontal axis (see FIG. 6) and are driven by the transmission. The peripheral , surfaces of applicator wheel 30 and spinner roll 32 can have surfaces of especially high quality, such as the surface which can be produced by plasma coating. The two end surfaces of applicator wheel 30 have an outward-curving, conical form. Glue tank 34 is partially filled with adhesive, and the lower part of applicator wheel 30 is immersed in the adhesive. Above the surface of the glue, but projecting partially into glue tank 34, there is a main doctor blade 40 (see FIGS. 3 and 4), which is mounted directly next to the peripheral surface of applicator wheel 30. The task of this doctor blade is to wipe off excess glue adhering to applicator wheel 30 and thus to limit the mount of glue which is transferred. Main doctor blade 40 is set up at an angle of about 45° to the horizontal and can be moved by means of a pneumatically actuated piston in such a way that the width of the gap formed between main doctor blade 40 and applicator wheel 30 can be varied. Another doctor blade 42 is mounted between applicator wheel 30 and spinner roll 32 to wipe adhesive from applicator wheel 30. Another doctor blade 44 is mounted behind spinner roll 32, i.e., "behind" with respect to the direction in which the workpieces to be glued are moving. Doctor blades 42, 44 are also adjustable.

The direction in which the workpieces to be glued are moving is indicated in FIG. 3 by an arrow drawn on applicator wheel 30.

Doctor blades 40, 42, 44 are mounted, jointly with transmission unit 20, to which applicator wheel 30 and spinner roll 32 are connected, on a separate frame 46, which in turn is attached by one of its sides 48 in a hinge-like manner to frame 2 in such a way that it can pivot; the entire frame 46 can thus be flipped upward by raising opposite side 50 of the frame and held in the up position by means of a latching bolt. When frame 46 is in this flipped-up position, convenient access is provided to glue tank 34 and to doctor blades 40, 42, 44, so that they can, for example, be cleaned.

Figure 4:
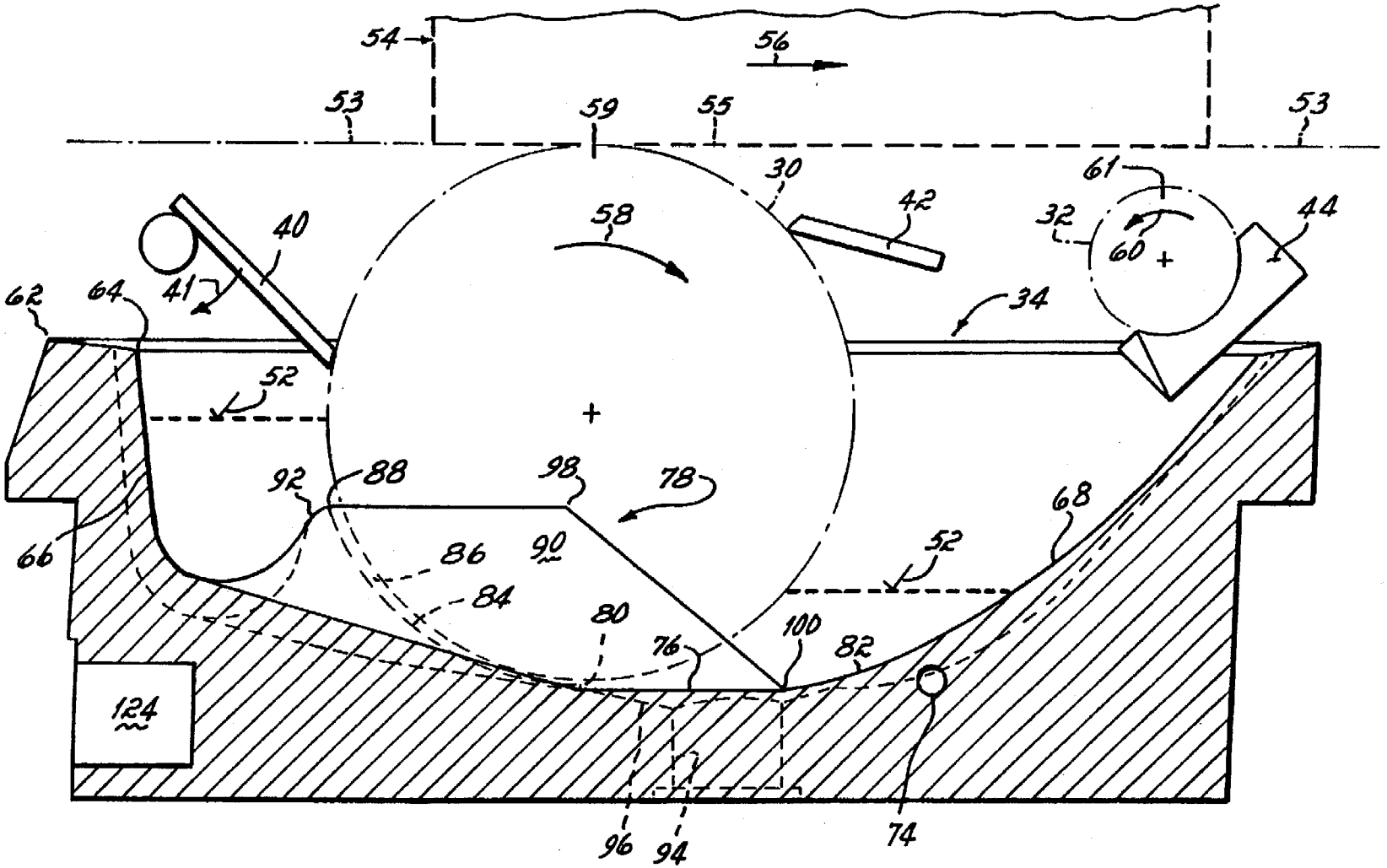
FIG. 4 shows a cross section of an embodiment of a glue tank with a built-in doctor blade device, the outlines of an applicator wheel and a spinner roll also being shown.
Figure 5:
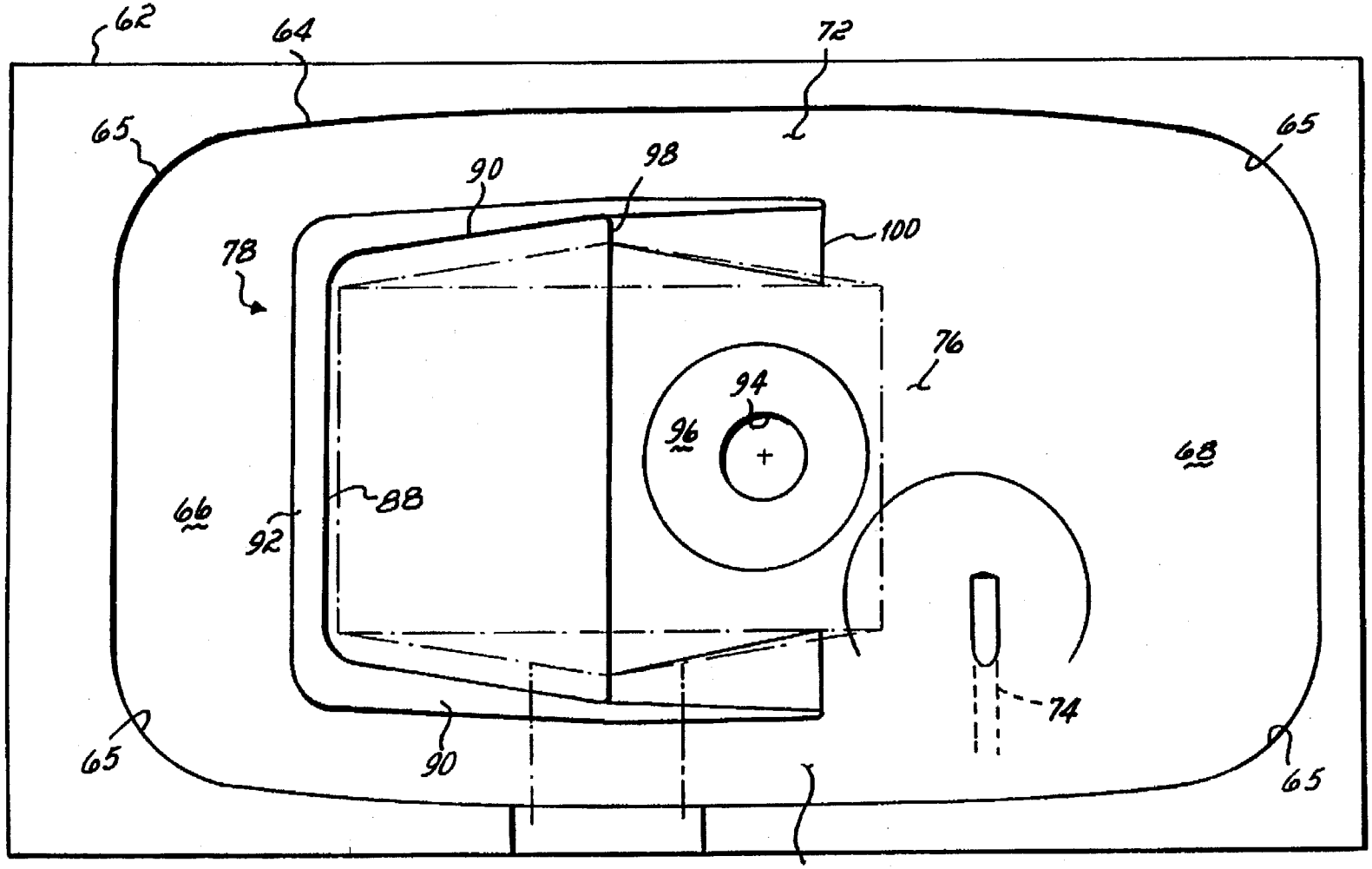
FIG. 5 shows a top view onto the glue tank shown in FIG. 4 without the applicator wheel and spinner roll.

As can be seen in FIG. 4, the lower part of applicator wheel 30 is immersed in glue tank 34, which is filled with adhesive; the height of the glue in the tank is identified by appropriate markings 52. Above applicator wheel 30 and spinner roll 32, there is a book block 54 to be glued, shown in broken line. The direction in which the block is moving is indicated by an arrow 56. In FIG. 4, spinner roll 32 is shown in its lowered position, in which the distance between it and spine 55 is greater than the distance between applicator wheel 30 and spine 55. The distance between spinner roll 32 and the spine can be reduced, however, by means not shown. Book blocks 54 are therefore (as shown in FIGS. 4 and 5) fed toward the applicator wheel from the left and leave the area of the glue tank toward the right. The rotational directions of applicator wheel 30 and spinner roll 32 are indicated by arrows 58, 60. Glue tank 34 has an upper outside edge 62, which, in FIG. 5, appears as a rectangle; an upper inside edge 64, situated farther inward and somewhat lower down, has slightly rounded corners 65. In the inside area of glue tank 34, in the forward end with respect to the arriving book blocks 54, a nearly vertical forward end wall 66 of glue tank 34 continues into a bottom area, whereas, at the back end, a less steeply angled rear end wall 68 continues into the bottom area. The forward and back end walls 66, 68 are connected by two side walls 70, 72. In the transition area between side wall 70 and end wall 68, a horizontal inlet hole 74, coming from outside of the glue tank, has its opening; a supply line (not shown) for introducing adhesive is connected to this inlet hole; the opening of this supply line has an elongated appearance, as shown in FIG. 5.

A doctor blade device 78 is built into the bottom 76 of glue tank 34 near the lower part of applicator wheel 30; this doctor blade device consists of a step 80, approximately at the lowermost point of the wheel's periphery and extending axially with respect to the wheel. This step is located between a first bottom section 82 of glue tank 34 relatively far away from the peripheral surface of the wheel and a second bottom section 84, following in the direction of rotation, relatively close to the peripheral surface, with the result that a gap 86 is formal between applicator wheel 30 and second bottom section 84. The step has an approximate height of 1–2 mm, and the distance between it and the peripheral surface of applicator wheel 30 is about 5/10 mm to 7/10 mm. Gap 86 ends at an edge 88 and is bounded on the sides by two walls 90. In the forward area of glue tank 34, doctor blade device 78 drops down from edge 92 and continues toward the left as forward end wall 66.

At the deepest part of bottom 76, a vertical outlet hole 94 is provided, which can be connected to an outlet line (not shown) by means of an internal thread. A kind of collecting basin 96 is recessed into bottom 76 near outlet hole 94. Side walls 90 are approximately horizontal at their highest point, starting from edge 88 and extending all the way to edge 98, and then they drop down in the rear area to bottom section 82, ending at a crease 100 in floor 76 of glue tank 34.

Figure 6:
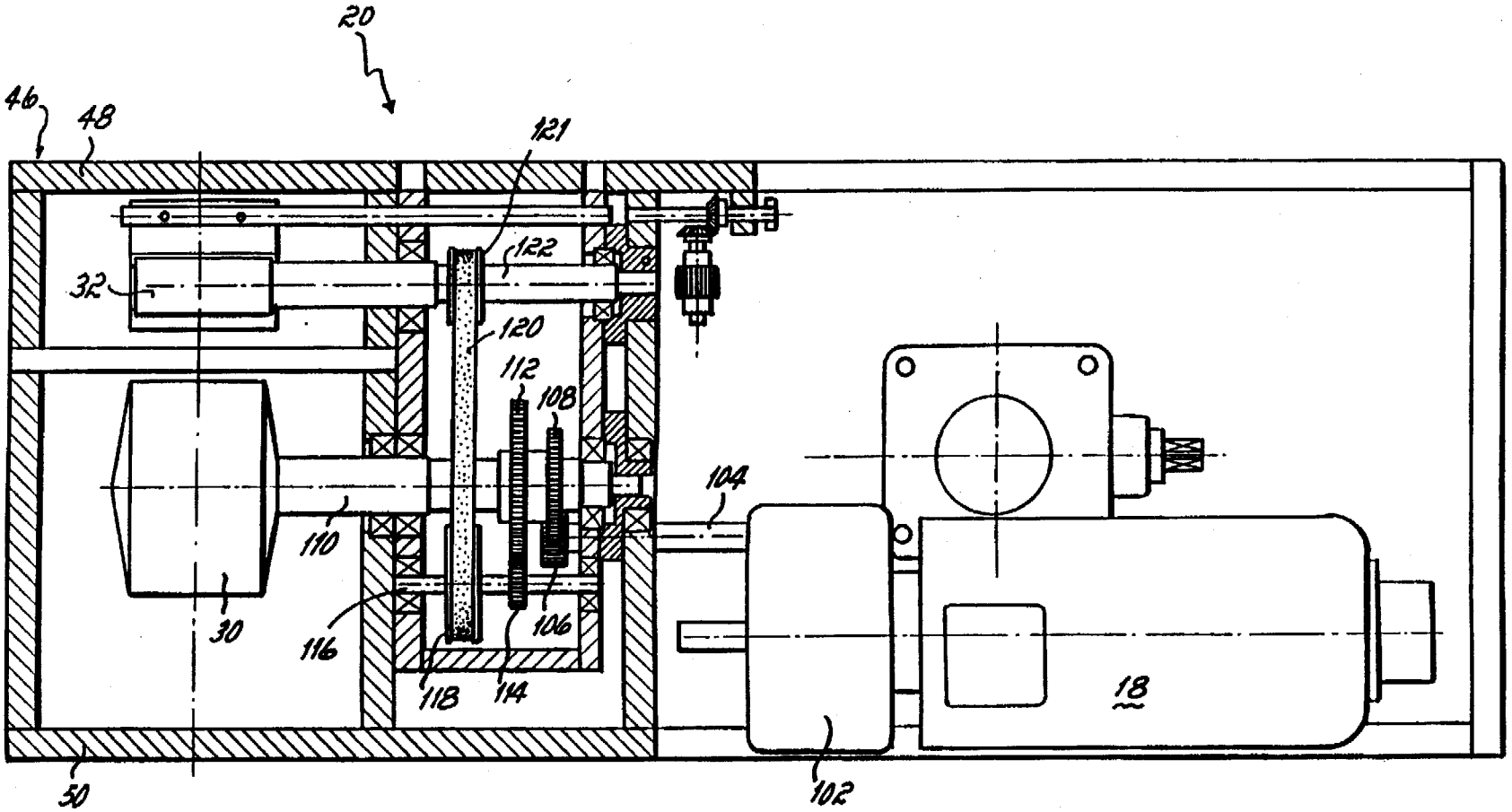
FIG. 6 shows an embodiment of a drive unit with electric motor, transmission unit, applicator wheel, and spinner roll in partial cross section.

As can be seen from FIG. 6, electric motor 18 makes use of an intermediate gear 102 to drive, in a manner not shown, a countershaft 104 of transmission unit 20. At one end of countershaft 104 there is a gear wheel 106, which meshes with a gear wheel 108 on applicator wheel shaft 110. A gear wheel 112, also mounted on applicator wheel shaft 110, engages with a pinion 114, which drives a second countershaft 116, on which a wheel 118 is mounted, by way of which a spinner roll shaft 122 is driven by means of a toothed belt 120 and an additional wheel 121. Both applicator wheel 30 and spinner roll 32 are supported in cantilever fashion.

The way in which the wheel applicator device according to the invention functions is described in the following.

First, wheel applicator device 1 is pushed into position near a bookbinding machine (not shown), so that applicator wheel 30 and spinner roll 32 are underneath the conveyors and guides (not shown) of the bookbinding machine, Then applicator wheel 30 and spinner roll 32 are adjusted in the vertical direction by turning hand crank 16 to raise or lower the frame. The conveyors and guides convey book blocks 54 to be glued forward at an adjustable speed; the blocks are aligned so that the length dimension of book spines 55 is perpendicular to the axis of applicator wheel 30 and so that the spines are conducted past the top apex line of the peripheral surface of applicator wheel 30. Book spines 55 to be glued thus come into contact with the adhesive, which was picked up in the lower part of the glue tank and which is adhering to the peripheral surface of applicator wheel 30; in this way the glue is transferred to book spine 55. Excess glue adhering to the spine is removed or pressed into the intermediate spaces between the pages of the book by spinner roll 32, which rotates in the direction opposite that of applicator wheel 30. The peripheral velocity of applicator wheel 30 is exactly the same as the transport speed of the book blocks, which is accomplished by the coupling of controller device 24 to an electrical signal transmitter with a sensor, the signal transmitter being mounted rigidly inside the bookbinding machine in such a way that its sensor can detect the motion of book blocks 54. As a result, a signal corresponding to the speed of book blocks 54 is available at the output of the signal transmitter for use by control device 24. The signal can be transmitted by the signal transmitter in a wireless manner or by means of a sable, which can be plugged into a jack in control device 24.

The conveyors and guides of the bookbinding machine push book blocks 54 forward at a constant speed in such a way that spines 55 are in a horizontal plane 53. The two top apex lines 59, 61 of the peripheral surfaces of applicator wheel 30 and spinner roll 32 are directly adjacent to plane 53. So that the action of spinner roll 32 on spines 55 glued by applicator wheel 30 can be varied with the goal of changing the amount of glue applied, the distance between spinner roll 32 and plane 53 and thus the distance between apex line 61 and plane 53 can be adjusted by the use of means (not shown) for a adjusting the height of spinner roll shaft 122, these means being provided inside transmission unit 20 and comprising, for example, pneumatic cylinders, the piston rods of which act on guide shoes, which are supported in such a way that they can slide vertically inside the housing wall. The bearings for spinner roll shaft 122 are installed in these shoes. In the exemplary embodiment of drive unit 22 shown especially in FIG. 6, the speed and direction of rotation of spinner roll 32 are coupled "rigidly" to the speed of applicator wheel 30, but it is also possible, of course, to provide an independent drive for spinner roll 32.

Fresh adhesive is introduced at a metered flow rate into glue tank 34 through inlet hole 74 (FIGS. 4 and 5) from an adhesive preparation device (not shown). A relatively large amount of the adhesive supplied to the tank is subjected inside the glue tank to the currents caused by the rotation of applicator wheel 30 and is thus conveyed toward a narrowing gap, formed between first bottom section 82 and a section of the peripheral surface of applicator wheel 30 opposite that part of the bottom. At step 80, comprising part of doctor blade device 78, the adhesive arrives in gap 86 and is transported through it. By virtue of the special design of doctor blade device 78, most of the adhesive introduced into gap 86 passes directly through the gap and is carried from there, because of its adherence to the peripheral surface of applicator wheel 30, past main doctor blade 40 and onto book spines 55 to be glued. By varying the distance between main doctor blade 40 and applicator wheel 30, it is possible to vary the thickness of the film of adhesive adhering to applicator wheel 30, this possibility being necessary so that the application of adhesive can be adapted to suit the interval between one book block 54 to be glued and the following block and also to suit the length of spine 55. Another sensor is provided for this, which signals the arrival of a book block above the forward area of the glue tank.

The above-mentioned signal transmitter inside the bookbinding machine supplies a frequency signal, also mentioned above, which is proportional to the speed of the machine. This signal is also used as a distance signal for the control of main doctor blade 40. In this way, it is possible to apply glue intermittently to applicator wheel 30, which is preferred, this glue then being transferred to the spine of the book. Main doctor blade 40 opens and closes with each book passing by the wheel, corresponding to arrow 41 in FIG. 4. The control system is set up so that the length over which glue is applied is kept constant no matter how the speed of forward feed may change. An electromagnetically driven pneumatic cylinder (not shown in the drawing for the sake of clarity) is used to move main doctor blade 40 in the direction indicated by arrow 41.

Some of the excess adhesive present in the forward area of glue tank 34 near front end wall 66 can flow around side walls 90 to the rear area of glue tank 34, and some of this adhesive can be returned through outlet hole 94 to the adhesive preparation device. Doctor blades 42, 44 also serve to wipe off excess adhesive from applicator wheel 30 and spinner roll 32, respectively. Step 80 of doctor blade device 78 is about 1 mm high, and a gap with a width of about 5/10–7/10 mm is formed between it and the applicator wheel.

Applicator wheel 30, spinner roll 32, and glue tank 34 can be heated electrically or by means of a thermal transfer fluid, if the properties of the adhesive require it. In the case of an electric heating system, heating wires are provided in the walls of glue tank 34, close to the inside surface of the tank, and along and just inside the peripheral surfaces of applicator wheel 30 and spinner roll 32. The heating wires in glue tank 34 are supplied with current from an electrical terminal 124, whereas the heating wires inside the applicator wheel are supplied by means of carbon brushes acting on shaft 110 of the applicator wheel. When a thermal transfer fluid is used to heat the adhesive, the heating wires are essentially replaced by channels. The temperatures of the heated parts can be regulated by means of a controller installed inside the control device. Protection against overheating can also be provided.

Electric motor 18 is connected to a high-amperage line in a manner not shown.

What is claimed:

1. Wheel apparatus for applying adhesive, said apparatus comprising:

a driven adhesive applicator wheel having a circumferential peripheral surface for picking up and transporting adhesive and two opposed sides, said wheel being rotatable about an axis which is substantially horizontally disposed;

an adhesive reservoir;

two opposed walls disposed within and extending upwardly from a bottom of said reservoir;

a portion of said wheel below said axis being disposed between said walls;

said reservoir having an adhesive metering surface disposed and extending between said two opposed walls in said reservoir and being curved in a direction of rotation of said wheel;

said metering surface defining a step in said reservoir proximate a lowermost portion of said rotatable wheel;

said metering surface extending gradually upwardly from said step and gradually diverging upwardly and away from said circumferential peripheral surface of said wheel;

said metering surface having a terminal edge spaced further from said peripheral edge of said wheel than said step; and said metering surface and said two opposed walls in said reservoir being closely adjacent said wheel peripheral surface and said wheel sides respectively, below said axis, for operatively controlling the amount of adhesive on said peripheral surface and on each side of said wheel.

2. Wheel apparatus as in claim 1 wherein said peripheral surface of said wheel is disposed about 0.5 mm to about 0.7 mm from said step.

3. Wheel apparatus as in claim 1 wherein said two opposed walls extend upwardly from a bottom of said reservoir for a distance which is approximately one-third the diameter of said wheel.

4. Wheel apparatus as in claim 1 wherein said reservoir has a first adhesive chamber and a second adhesive chamber, said first adhesive chamber defined in part by interior walls of said reservoir, said step, and a descending portion of said rotatable wheel, a lower portion of said descending portion of said wheel being immersed in adhesive in said first chamber when said first chamber is filled with adhesive; and wherein said second chamber is disposed in said reservoir in a position above said first chamber and adjacent an ascending portion of said rotatable wheel for receiving adhesive carried by said wheel from said first chamber.

5. Wheel apparatus as in claim 4 wherein said two opposed walls extend upwardly from a bottom of said adhesive reservoir a distance of about one-third the diameter of said wheel;

said reservoir having side walls; and said opposed walls defining, with said side walls, recirculation channels therebetween for transferring adhesive from said second chamber back to said first chamber.

6. Wheel apparatus as in claim 1 wherein said two opposed walls extend upwardly from a bottom of said reservoir a distance of about one-third the diameter of said wheel and define between said respective opposed walls and side walls of said reservoir two side recirculation channels for receiving adhesive from an ascending portion of said wheel and transferring adhesive to a space in said reservoir adjacent a descending portion of said wheel outside said two opposed walls.

7. Wheel apparatus as in claim 1 wherein said reservoir has an inclined bottom and two adhesive chambers, said two chambers communicating outside said two opposed walls and being partially separated by said opposed walls and said metering surface.

8. Wheel apparatus as in claim 1 wherein said two opposed walls and said metering surface define a trough surrounding a lower portion of said wheel and controlling the amount of adhesive carried by said wheel from said reservoir.

9. Wheel apparatus as in claim 1 further comprising a counter-rotating spinner wheel for engaging adhesive applied to said applicator wheel, both of said wheels being mounted on a frame pivoted to said reservoir, said frame being pivotable to lift said wheels from said reservoir for reservoir cleaning.

10. Wheel apparatus as in claim 1 wherein further comprising a movable frame for transport to and from a book binding machine, and wherein the height of said frame is adjustable on to operatively dispose said applicator wheel in a position to apply adhesive thereon to a book block.

* * * * *